US009347277B2

(12) United States Patent
Taherian et al.

(10) Patent No.: US 9,347,277 B2
(45) Date of Patent: May 24, 2016

(54) SYSTEM AND METHOD FOR COMMUNICATING BETWEEN A DRILL STRING AND A LOGGING INSTRUMENT

(75) Inventors: Reza Taherian, Sugar Land, TX (US); Harold Steven Bissonnette, Sugar Land, TX (US); Chris Del Campo, Houston, TX (US); Laurent Villegas, Houston, TX (US); Shardul Sarhad, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1058 days.

(21) Appl. No.: 12/728,894

(22) Filed: Mar. 22, 2010

(65) Prior Publication Data

US 2011/0073303 A1 Mar. 31, 2011

Related U.S. Application Data

(60) Provisional application No. 61/163,737, filed on Mar. 26, 2009.

(51) Int. Cl.
*E21B 47/01* (2012.01)
*E21B 17/02* (2006.01)
*E21B 47/12* (2012.01)

(52) U.S. Cl.
CPC ..... *E21B 17/028* (2013.01); *E21B 47/01* (2013.01); *E21B 47/12* (2013.01)

(58) Field of Classification Search
CPC ..... E21B 23/14; E21B 19/22; E21B 47/01; E21B 47/011; E21B 47/12; E21B 17/028
USPC ..... 166/250.01, 381, 242.7, 65.1, 254.2; 175/321, 320, 40, 50
See application file for complete search history.

(56) References Cited

U.S. PATENT DOCUMENTS

| | | | | |
|---|---|---|---|---|
| 4,676,310 | A * | 6/1987 | Scherbatskoy et al. | 340/853.4 |
| 4,715,446 | A * | 12/1987 | Wittrisch | 166/381 |
| 4,898,241 | A * | 2/1990 | Wittrisch | 166/250.17 |
| 5,186,048 | A * | 2/1993 | Foster et al. | 73/152.02 |
| 5,215,151 | A * | 6/1993 | Smith et al. | 175/45 |
| 5,433,276 | A | 7/1995 | Martain et al. | |
| 5,521,592 | A * | 5/1996 | Veneruso | 340/854.8 |
| 6,092,416 | A | 7/2000 | Halford et al. | |
| 6,174,001 | B1 | 1/2001 | Enderle | |

(Continued)

FOREIGN PATENT DOCUMENTS

| | | | |
|---|---|---|---|
| EP | 0143192 | A2 | 6/1985 |
| EP | 1635035 | A1 | 3/2006 |

(Continued)

OTHER PUBLICATIONS

European Search Report dated Nov. 15, 2011 for corresponding EP Application No. 10003031.1.

*Primary Examiner* — Elizabeth Gitlin
(74) *Attorney, Agent, or Firm* — Kimberly Ballew

(57) ABSTRACT

A wireline configurable well logging instrument is connected to a drill pipe carrier and movable from a retracted position to an extended position. The drill pipe carrier is positioned on a pipe string that may comprise a portion of wired pipes communicatively coupled at each joint. Communication between the drill pipe carrier and the well logging instrument includes the use of inductive couplers, wires and combinations thereof.

19 Claims, 3 Drawing Sheets

(56) References Cited

U.S. PATENT DOCUMENTS

| | | | | |
|---|---|---|---|---|
| 6,641,434 | B2 | 11/2003 | Boyle et al. | |
| 7,237,626 | B2 * | 7/2007 | Gurjar et al. | 175/320 |
| 7,565,834 | B2 * | 7/2009 | Adnan | E21B 43/14 73/152.12 |
| 2006/0087449 | A1 | 4/2006 | Radzinski | |
| 2007/0221412 | A1 | 9/2007 | Hall et al. | |
| 2008/0066905 | A1 * | 3/2008 | Aivalis et al. | 166/250.01 |
| 2008/0202767 | A1 | 8/2008 | Sheiretov et al. | |
| 2009/0014175 | A1 | 1/2009 | Peter | |
| 2009/0095490 | A1 * | 4/2009 | Moriarty et al. | 166/383 |

FOREIGN PATENT DOCUMENTS

| | | | |
|---|---|---|---|
| GB | 2372057 | A | 8/2002 |
| GB | 2372521 | A | 8/2002 |
| GB | 2407334 | A | 4/2005 |
| WO | 02073003 | A1 | 9/2002 |

* cited by examiner

SYSTEM AND METHOD FOR COMMUNICATING BETWEEN A DRILL STRING AND A LOGGING INSTRUMENT

BACKGROUND OF THE INVENTION

Background Art

Well logging instruments are devices configured to move through a wellbore drilled through subsurface rock formations. The devices include one or more tools and other devices that measure various properties of the subsurface rock formations and/or perform certain mechanical acts on the formations, such as drilling or percussively obtaining samples of the rock formations, and withdrawing samples of connate fluid from the rock formations. Measurements of the properties of the rock formations may be recorded with respect to the instrument axial position (depth) within the wellbore as the instrument is moved along the wellbore. Such recording is referred to as a "well log."

Well logging instruments can be conveyed along the wellbore by extending and withdrawing an armored electrical cable ("wireline"), wherein the instruments are coupled to the end of the wireline. Extending and withdrawing the wireline may be performed using a winch or similar spooling device known in the art. However, such conveyance relies on gravity to move the instruments into the wellbore, which can only be used on substantially vertical wellbores. Those wellbores deviating from vertical require additional force to move through the wellbore.

There are several types of wireline instrument conveyance known in the art for the foregoing conditions. One conveyance technique includes coupling the wireline instruments to the end of a coiled tubing having a wireline disposed therein. The wireline instruments are extended into and withdrawn from the wellbore by extending and retracting the coiled tubing, respectively. A subset of such coiled tubing techniques includes preliminary conveyance of the wireline configurable well logging instruments to a selected depth in the wellbore. See, for example, U.S. Pat. No. 5,433,276 issued to Martain et al. However, the use of coiled tubing with wireline instruments is costly and is inherently limited by the amount of pushing force capable with the coiled tubing. As a result, the use of coiled tubing is typically problematic in extended reach wells.

Another well logging instrument conveyance technique includes coupling wireline configurable well logging instruments to the end of a drill pipe or similar threadedly coupled pipe string. A wireline is coupled to the instruments using a "side entry sub" which provides a sealable passage from the exterior of the pipe string to the interior thereof. As the pipe string is extended into the wellbore, the foregoing is described in U.S. Pat. No. 6,092,416 issued to Halford et al. and wireline is extended by operating a conventional winch. An example of the assigned to the assignee of the present invention. However, this conveyance technique is frequently unreliable as the wireline is positioned in the annulus and subject to crushing, splicing or other damage. For example, the wireline may become pinched between the drill pipe and the casing or wellbore. Another drawback to using drill pipe to convey the well logging instruments using procedures known in the art is that the cable disposed outside the pipe disturbs the operation of the sealing equipment and makes it difficult to seal the drill pipe to maintain fluid pressure.

Additionally, the well logging instruments may be positioned at the end of a drill pipe without use of a wireline cable. In such circumstances, each well logging instrument is provided with a battery and memory to store the acquired data. As a result, the well logging instruments cannot communicate with the surface while downhole. Therefore, the data acquired cannot be analyzed at the surface until the wireline instruments return to the surface. Without any communication with the surface, surface operators cannot be certain the instruments are operating correctly, cannot control the instruments while downhole, and the data cannot be analyzed until after the wireline instruments are removed from the wellbore.

Recently, a type of drill pipe has been developed that includes a signal communication channel. See, for example, U.S. Pat. No. 6,641,434 issued to Boyle et al. and assigned to the assignee of the present invention. Such drill pipe, known as wired drill pipe, has in particular provided substantially increased signal telemetry speed for use with LWD instruments over conventional LWD signal telemetry, which typically is performed by mud pressure modulation or by very low frequency electromagnetic signal transmission.

However, the foregoing wired drill pipe having a signal communication channel has not proven effective at transmitting electrical power from the surface to an instrument string disposed at a lower end of the pipe. In wireline conveyance of wellbore instrument, electrical power is transmitted from the surface to the instruments in the wellbore using one or more insulated electrical conductors in the wireline cable. In MWD and LWD, electrical power may be provided by batteries, or by an electric generator operated by flow of fluid through the pipe. When wired pipe is used for signal telemetry, the amount of electrical power required by the instruments may be substantially reduced, because the signal telemetry device used in MWD/LWD, typically a mud flow modulator, uses a substantial portion of the total electrical power used by the instruments in the bottom hole assembly.

Using wired drill pipe to convey signals and/or data to and from the wireline instruments, however, still presents problems due to the elimination of the traditional wireline cable to deliver power and communications to the wireline tools. Additionally, the medium of communication provided by wired drill pipe must be adapted to the wireline system, particularly in applications that require a drillpipe carrier ("DPC") to protect slim or sensitive wireline tools while running in open hole in which the DPC can create blockages to the wiring required for the wired drill pipe communication. The present invention, however, provides solutions to implementing wireline tools on a wired drill pipe string.

DETAILED DESCRIPTION

Generally, the invention relates to a system and method for communicating with a wellbore instrument or a "string" of such instruments in a wellbore using a wired pipe string for conveyance and signal communication. The wired pipe string may be assembled and disassembled in segments to effect conveyance in a manner known in the art for conveyance of segmented pipe through a wellbore. While the present invention is described as used with tools commonly conveyed on a wireline ("wireline tools"), the invention may be implemented with any other type of downhole tool like LWD tools. The description provided below relates to embodiments of the invention, and none of the embodiments are meant to limit the invention. The invention should be provided its broadest, reasonable meaning as defined by the claims.

Figure 1:
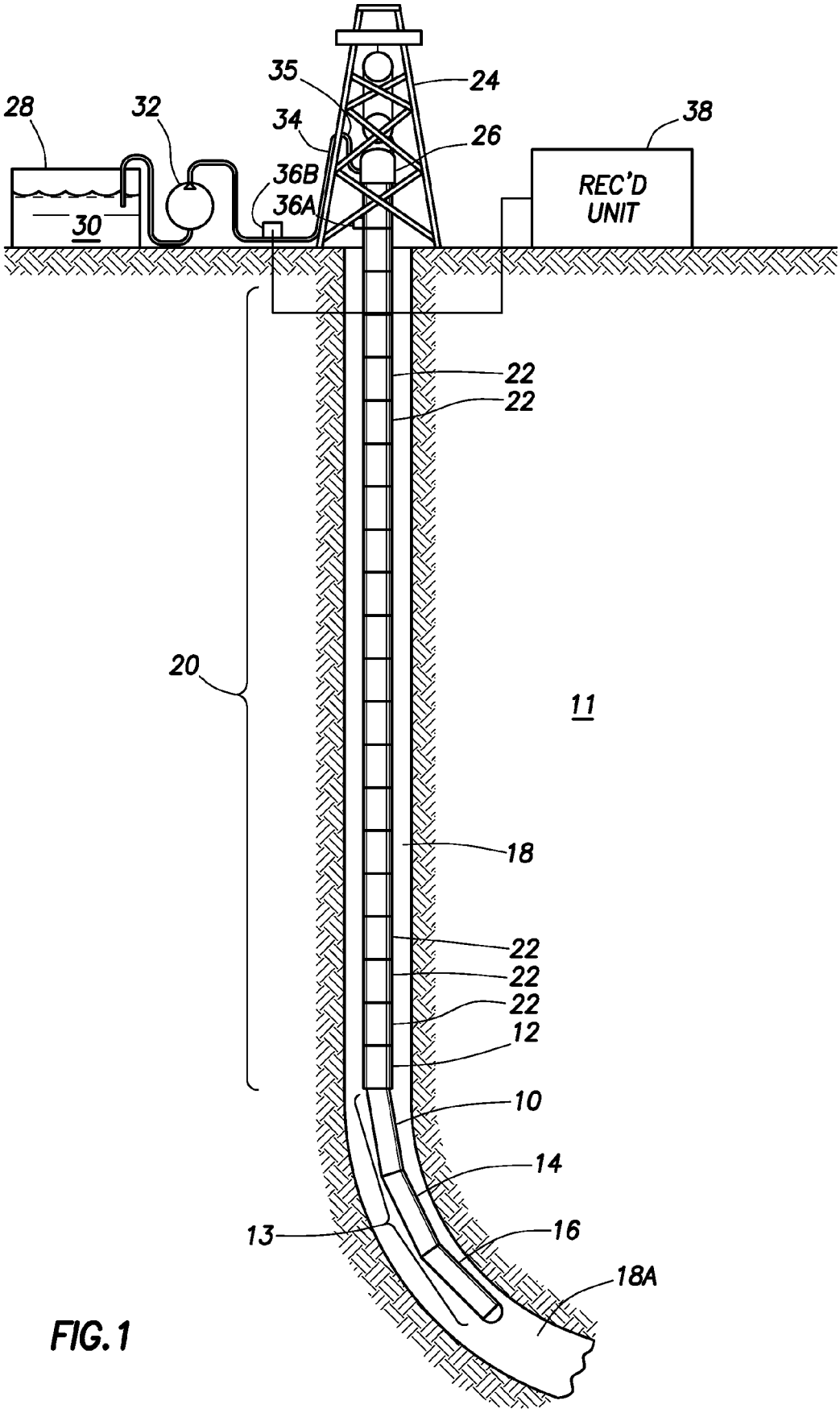
FIG. 1 illustrates a wired drill string having a well logging instrument in an embodiment of the present invention.

In FIG. 1, a drilling rig 24 or similar lifting device moves a wired pipe string 20 within a wellbore 18 that has been drilled through subsurface rock formations, shown generally at 11. The wired pipe string 20 may be extended into the wellbore 18 by threadedly coupling together end to end a number of segments ("joints") 22 of wired pipe or tubing. Wired pipe may be structurally similar to ordinary drill pipe (see, e.g., U.S. Pat. No. 6,174,001 issued to Enderle) and includes a cable associated with each pipe joint that serves as a signal communication channel. The cable may be any type of cable capable of transmitting data and/or signals, such as an electrically conductive wire, a coaxial cable, an optical fiber or the like. Wired pipe typically includes some form of signal coupling to communicate signals between adjacent pipe joints when the pipe joints are coupled end to end as shown in FIG. 1. See, as a non-limiting example, U.S. Pat. No. 6,641,434 issued to Boyle et al. and assigned to the assignee of the present invention for a description of one type of wired drill pipe having inductive couplers at adjacent pipe joints that may be used with the present invention. However, the present invention should not be limited to the wired pipe string 20 and can include other communication or telemetry systems, including a combination of telemetry systems, such as a combination of wired drill pipe, mud pulse telemetry, electronic pulse telemetry, acoustic telemetry or the like.

The wired string 20 may include one, an assembly, or a "string" of wellbore instruments at a lower end thereof. In the present example, the wellbore instrument string may include wireline configurable well logging instruments 13 coupled to a lower end thereof. As used in the present description, the term "wireline configurable well logging instruments" or a string of such instruments means one or more well logging instruments that are capable of being conveyed through a wellbore using armored electrical cable ("wireline"). Wireline configurable well logging instruments are thus distinguishable from "logging while drilling" ("LWD") instruments, which are configurable to be used during drilling operations and form part of the pipe string itself. The purpose for coupling the wireline configurable logging instrument string 13 (hereinafter "well logging instrument 13") to the end of the wired pipe string 20 will be further explained below. While generally referred to as the well logging instrument 13, the well logging instrument 13 may consist of one, an assembly, or a string of wireline configurable logging instruments.

Several of the components disposed proximate the drilling unit 24 may be used to operate components of the system. These components will be explained with respect to their uses in drilling the wellbore to better enable understanding the invention. The wired pipe string 20 may be used to turn and axially urge a drill bit into the bottom of the wellbore 18 to increase its length (depth). During drilling of the wellbore 18, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the pipe string 20. The mud 30 exits the drill string 20 through courses or nozzles (not shown separately) in the drill bit, where it then cools and lubricates the drill bit and lifts drill cuttings generated by the drill bit to the Earth's surface.

When the wellbore 18 has been drilled to a selected (or predetermined) depth, the pipe string 20 may be withdrawn from the wellbore 18. An adapter sub 12 and the well logging instrument 13 may then be coupled to the end of the pipe string 20, if not previously installed. The pipe string 20 may then be reinserted into the wellbore 18 so that the well logging instrument 13 may be moved through, for example, a highly inclined portion 18A of the wellbore 18, which would be inaccessible using armored electrical cable ("wireline") to move the instruments 24. The well logging instrument 13 may be positioned on the pipe string 20 in other manners, such as by pumping the well logging instrument 13 down the pipe string 20 or otherwise moving the well logging instrument 13 down the pipe string 20 while the pipe string 20 is within the wellbore 18.

During well logging operations, the pump 32 may be operated to provide fluid flow to operate one or more turbines (not shown in FIG. 1) in the well logging instrument 13 to provide power to operate certain devices in the well logging instrument 13. Power may be provided to the well logging instrument 13 in other ways as well. For example, the turbine(s) may be used to provide power to the recharge batteries located either in a special power sub or in each individual instrument or tool. In other examples, the wired pipe string 20 may be rotated to provide power to the well logging instrument 13. In still other examples, batteries may be used to operate the well logging instrument 13. In a non-preferred embodiment, power may be transmitted downhole through the wired drill string 20, and, in such an embodiment, may be amplified or used to power or recharge a battery in the special power sub to provide power to the instruments. The foregoing examples of power provision may be used individually or in any combination. Other manners of powering the well logging instrument 13 may be used as appreciated by those having ordinary skill in the art.

As the well logging instrument 13 is moved along the wellbore 18 by moving the pipe string 20 as explained above, signals detected by various devices, non-limiting examples of which may include an induction resistivity instrument 16, a gamma ray sensor 14 and a formation fluid sample taking device 10 (which may include a fluid pressure sensor (not shown separately)). At the surface, a telemetry transmitter/receiver 36A can be used to wirelessly transmit signals from the wired pipe string 20 to a transmitter/receiver 36B. Thus, the wired pipe string 20 may be freely moved, assembled, disassembled and rotated without the need to make or break a wired electrical or optical signal connection. Signals from the receiver 36B, which may be electrical and/or optical signals, for example, may be transmitted (such as by wire, cable or wirelessly) to a recording unit 38 for decoding and interpretation using techniques well known in the art. The decoded signals typically correspond to the measurements made by one or more of the sensors in the well logging instruments 10, 14, 16. Other sensors known in the art include, without limitation, density sensors, neutron porosity sensors, acoustic travel time or velocity sensors, seismic sensors, neutron induced gamma spectroscopy sensors and microresistivity (imaging) sensors. In another embodiment the signal or commands can be transmitted from the surface recording unit 38 via 36B and 36A to the well logging instrument 13. The recording unit 38 may comprise a processor for processing data as well as other components to receive, manipulate and convert data.

The functions performed by the adapter sub 12 may include providing a mechanical coupling (explained below) between the lowermost threaded connection on the wired pipe string 20 and an uppermost connection on the well logging instrument 13. The adapter sub 12 may also include one or more devices (explained below) for producing electrical and/or hydraulic power to operate various parts of the well logging instrument 13. The adapter sub 12 also includes the communication adapter circuit to allow the communication between the wired drill pipe and the well logging instrument 13. Finally, the adapter sub may include signal processing and recording devices (explained below) for selecting signals from the well logging instrument 13 for transmission to the surface using the wired pipe string 20 and recording signals in a suitable storage or recording device (explained below) in the adapter sub 12.

It will be appreciated by those skilled in the art that in other examples the top drive 26 may be substituted by a swivel, kelly, kelly bushing and rotary table (none shown in FIG. 1) for rotating the pipe string 20 while providing a pressure sealed passage through the pipe string 20 for the mud 30. Accordingly, the invention is not limited in scope to use with top drive drilling systems.

Figure 2:
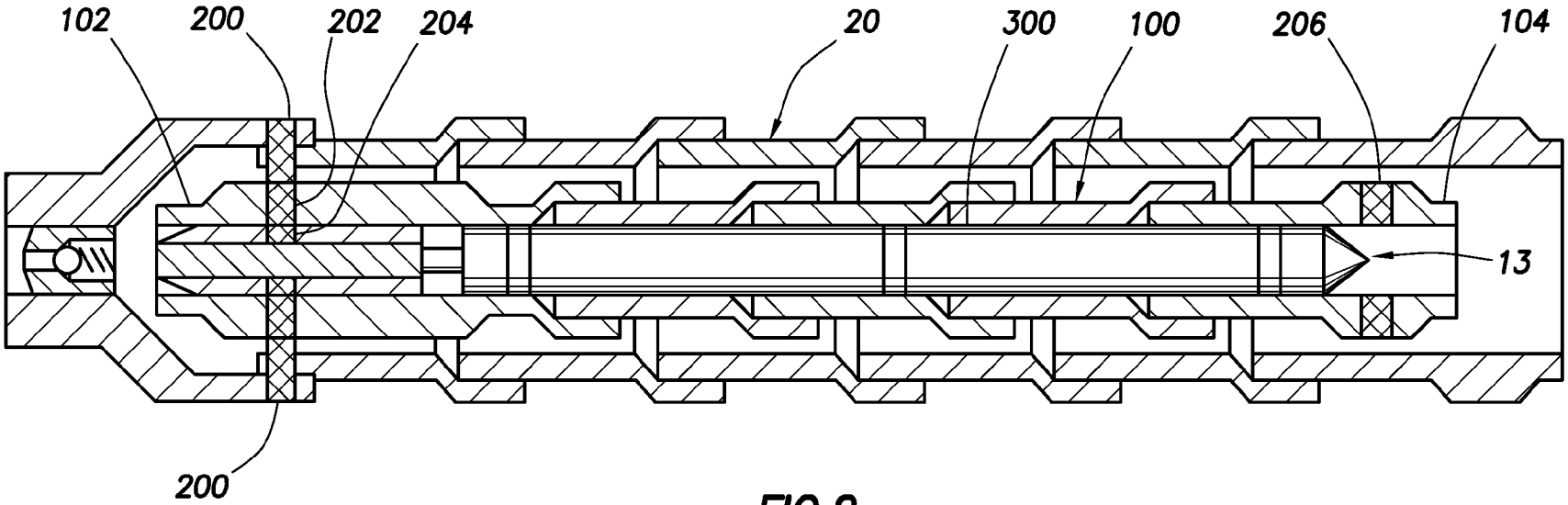
FIG. 2 illustrates a well logging instrument at a retracted position with respect to a drill pipe carrier in an embodiment of the present invention.
Figure 3:
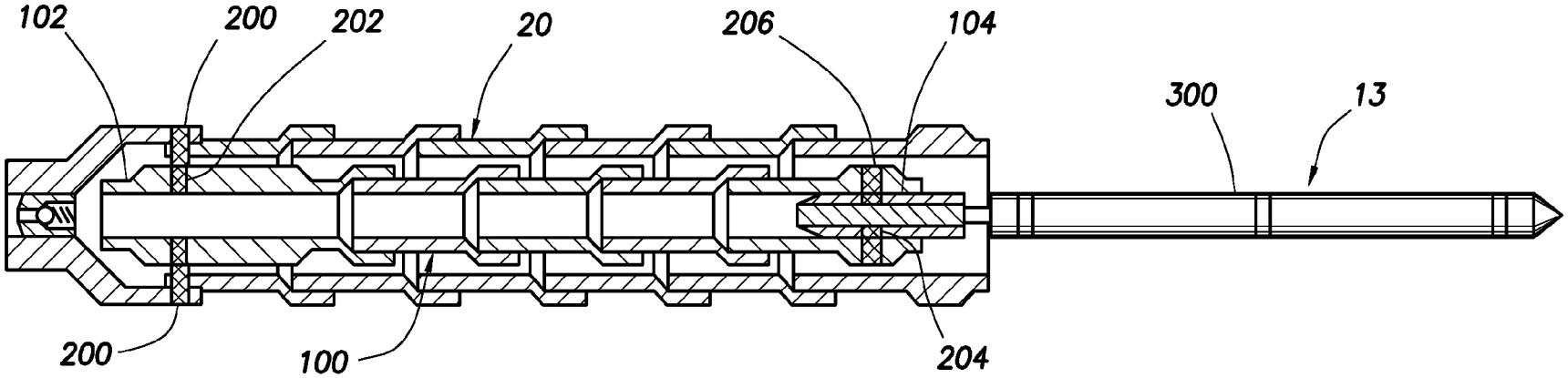
FIG. 3 illustrates a well logging instrument at an extended position with respect to a drill pipe carrier in an embodiment of the present invention.

Using drill pipe as a drill pipe carrier for the well logging instrument 13 may protect the well logging instrument 13 during deployment into the wellbore 18. The well logging instrument 13 may be latched or otherwise secured inside a drillpipe carrier 100 at a retracted position, as shown in FIG. 2, such that the well logging instrument 13 is completely or at least substantially encased by the drill pipe carrier 100 and not in contact with the casing or formation. For example, the well logging instrument 13 may be latched or otherwise secured at or near a top 102 of the drill pipe carrier 100. When the tool's functions are required, the well logging instrument 13 may be disengaged and move away from the top 102 of the drill pipe carrier 100 to an extended position and maintain communication with the wired drillpipe string 20, as shown in FIG. 3. Electrical signals, such as command signals, may be transmitted from Earth's surface (e.g. surface of the wellsite) to control the well logging instrument 13 and/or the drill pipe carrier 100. For example, a command may be transmitted along the wired pipes to move the well logging instrument to the extended position, the retracted position, or another position. The signals may also be transmitted from the adapter sub 12. For example, the adapter sub 12 may contain processing to determine if the well logging instrument 13 is properly positioned and should be retracted to begin obtaining measurements of the wellbore and/or formation surrounding the wellbore. The adapter sub 12 may receive control signals from a component at the surface of the wellsite, such as a processor, surface control unit, or other component. The control signals may be transmitted directly from the recording unit 38 or other component, such as a surface control unit or a processor at the surface of the wellsite, to the well logging instrument 13 and/or the drill pipe carrier 100.

In an embodiment, the well logging instrument 13 may drop, may be pumped, or may be otherwise be positioned at the extended position below the drill pipe carrier 100 such that the well logging instrument 13 is exposed to the formation. As an example, the top 102 of the well logging instrument 13 may move and may be secured or otherwise positioned at or near the bottom 104 of the drill pipe carrier 100 to expose the well logging instrument 13. In one particular embodiment, the top 102 of the drill pipe carrier 100 may be connected to the bottom of the wired drill pipe string; such as by a threaded connection (not shown) and contain the coupling mechanism of the wired drill pipe physical layer. The top portion of the drill pipe carrier 100 that may be threaded onto the wired drill pipe string 20 may also include a receiving wet-connector, such as the wet-connector traditionally used to perform a pump-down wet connect in wireline.

In another embodiment, the top portion of the drill pipe carrier 100 may include a wireline cable or other communication cable, which may be approximately the length of the drill pipe carrier 100. The wireline cable may connect the drill pipe carrier 100 to the top of the well logging instrument 13 inside the drill pipe carrier 100. In a particular example, the connection to the top of the wireline tool may be similar to the traditional connection made in existing wireline systems to the wireline cable. When the well logging instrument 13 is at the retracted position, the length of cable would be coiled or spooled inside the top portion of the drill pipe carrier. When the well logging instrument 13 is at the extended position, the length of cable may be substantially taut or straight to extend from the top to the bottom of the drill pipe carrier, maintaining a wired connection through the drill pipe carrier 100 to the well logging instrument 13.

Another embodiment of communicating across the drill pipe carrier 100 relates to use of one or more inductive couplers 200, 202, 204, 206, which may be substantially similar to the inductive couplers described in U.S. Pat. No. 6,641,434 issued to Boyle et al., and assigned to the assignee of the present invention. The inductive couplers 200, 202, 204, 206 may be positioned, for example, on the wired drill pipe string 20, the drill pipe carrier 100 and the well logging instrument 13 for bi-directional communication between the wired drill pipe string 20 and the well logging instrument 13. Generally, the inductive couplers 200, 202, 204, 206 may be positioned on or about the bottom of the wired drill pipe string 20, at or adjacent to the top and bottom of the drill pipe carrier, and at or adjacent to the top or bottom of the well logging instrument 13. In an embodiment, at the extended position of the well logging instrument 13, the inductive coupler 204 at the top of the well logging instrument 13 may communicate with the inductive coupler 206 at the bottom of the drill pipe carrier 100. In such an embodiment, the drill pipe carrier 100 may communicate with the wired drill pipe string 20 in any known manner, such as by use of inductive couplers 200, 202 at the top of the drill pipe carrier and at the bottom of the wired drill pipe string 20. The top of the drill pipe carrier 100 may have one or more inductive couplers 200 to provide bidirectional communication with the wired drill pipe string 20 and/or the well logging instrument 13 when at the retracted position.

In another embodiment, the inductive coupler 200 on the wired drill pipe string 20 may be connected with wiring to the top inductive coupler 202 and bottom inductive coupler 206 in the drill pipe carrier 100. This system would basically extend the physical layer of the wired drill pipe system into the drill pipe carrier 100, allowing two signal "jumper" points into the wireline tool. The wiring through the drill pipe carrier 100 may be substantially similar to that used in current formation sampling tools, in which the wiring is guided though a chamber that runs the length of the drill pipe carrier.

In yet another embodiment, acoustic couplers (not specifically shown) may be used for communication from the drill pipe carrier 100 to the well logging instrument 13 and/or from the drill pipe carrier 100 to the wired drill pipe string 20. For example, an acoustic coupler may be used to communicate directly from the top of the drill pipe carrier 100 to the well logging instrument 13. Advantageously, the acoustic coupler may be incorporated without any requirement for wiring in the drill pipe carrier 100. Another wireless communication can be obtained by using earth as communication link between the well logging instrument 13 and the drill pipe carrier 100 or any other component in the wired drill pipe uphole using electro-magnetic waves or radio frequency ("RF") waves.

In yet another embodiment, the drill pipe carrier 100 and the well logging instrument 13 and/or the wired drill pipe string 20 may be directly connected by connectors, such as wet-stab or wet-connect connectors used in downhole systems. Implementation may be accomplished by wiring the drill pipe carrier 100 or any wireless coupling means described.

Still another example of communication between the drill pipe carrier 100, well logging instrument 13 and the wired drill pipe string 20 includes use of an electromagnetic coupler. The drill pipe carrier 100 and/or the well logging instrument 13 may utilize the electromagnetic couplers to communicate directly from the drill pipe carrier to the well logging instrument 12, without use of any wiring.

The drill pipe carrier 100 may optionally include electronics 300 for transmitting and receiving signals related to the deployment and return of the well logging instrument 13 from the drill pipe carrier. The electronics 300 of the drill pipe carrier 100 are in communication with the wired drill pipe string 20 to provide a communication channel from the surface to the drill pipe carrier 100. The electronics 300, communication components, and power generation mechanisms may be incorporated into a separate sub that may be positioned between the drill pipe carrier 100 and the well logging instrument 13, such as the adapter sub 12.

The well logging instrument 13 may be secured and/or released by a latch release mechanism, which may use mud pressure or flow to engage and disengage the well logging instrument 13. The reverse of the deployment process may be performed to return the tool into the drill pipe carrier 100 after measurements are completed. Communications from the surface may be used to move the well logging instrument 13 from the retracted position to the extended position with respect to the drill pipe carrier 100 and back to the retracted position. The communications may permit analysis of data from the well logging instrument 13 in substantially real-time, control of the well logging instrument 13 in substantially real-time, diagnostics of the well logging instrument 13 in substantially real-time, and other advantages of utilizing a substantially real-time communication mechanism with the well logging instrument 13.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for communicating with a logging instrument:

a drill string comprising a plurality of drill pipes coupled end to end forming joints and a bottom portion extending into a wellbore, wherein at least a portion of the drill string comprises wired drill pipes coupled together and capable of transmitting data across the joint;

a drill pipe carrier positioned on the bottom portion of the drill string in communication with the wired drill pipes, wherein the drill pipe carrier comprises a top portion and a cable and the top portion of the drill pipe carrier is connected to the drill string with a coupling mechanism; and an instrument for measuring a property of the wellbore, the instrument is connected to the drill pipe carrier by the cable and is movable from a retracted position substantially within the drill pipe carrier and to an extended position substantially outside of the drill pipe carrier while remaining in communication with the wired drill pipe, wherein the instrument is in communication with the wired drill pipes in both the extended position and the retracted position, and in the retracted position, the cable is coiled or spooled inside the top portion of the drill pipe carrier and in the extended position, the instrument is dropped below the drill pipe carrier and the cable is substantially taut or straight.

2. The system of claim 1 further comprising a wet-connector positioned at the top portion of the drill pipe carrier for performing a pump-down wet connect in wireline.

3. The system of claim 1 further comprising inductive couplers positioned on the drill pipe carrier and the instrument.

4. The system of claim 1 further comprising: an inductive coupler positioned on the pipe string adjacent the drill pipe carrier and wired to an inductive coupler positioned on the drill pipe carrier.

5. The system of claim 1 wherein the instrument is a wireline configurable well logging instrument.

6. The system of claim 1 wherein the drill pipe carrier is connected directly to the wired drill pipes by a threaded connection.

7. The system of claim 1 wherein the coupling mechanism is an adapter sub positioned between the drill string and the drill pipe carrier, the adapter sub mechanically connecting the drill string to the drill pipe carrier.

8. The system of claim 7 wherein the adapter sub is positioned between the wired drill pipes and the top portion of the drill pipe carrier.

9. The system of claim 7 wherein the adapter sub generates power and transmits power to the instrument.

10. A method for transmitting information related to a wellbore drilled through a subsurface formation to Earth's surface comprising:

positioning a drill string in the wellbore, the drill string having a bottom portion extending into the wellbore wherein at least a portion of the drill string comprises wired pipes communicatively coupled each at a joint and capable of transmitting data therebetween;

connecting a drill pipe carrier to the bottom portion of the pipe string wherein the drill pipe carrier comprises a top portion and a cable, the drill pipe carrier is connected to the drill string with a coupling mechanism;

connecting an instrument to the drill pipe carrier with the cable, the instrument capable of measuring a property of the wellbore or the formation surrounding the wellbore;

moving the instrument from a retracted position to an extended position outside of the drill pipe carrier wherein the instrument remains in communication with the surface and in the refracted position, the instrument is not in contact with the formation or drill casing and is substantially encased within the drill pipe carrier and the cable is coiled or spooled inside the top portion of the drill pipe carrier, and in the extended position, the instrument is dropped below the drill pipe carrier and the cable is substantially taut or straight; and transmitting information to and from the instrument through the drill carrier to the surface.

11. The method of claim 10 further comprising: transmitting a control signal from a recording unit at a surface of the wellbore to the drill pipe carrier to move the instrument from the retracted position to the extended position.

12. The method of claim 10 wherein the instrument transfers data from and to the drill string with inductive couplers positioned on the drill pipe carrier and the instrument.

13. The method of claim 12 wherein the instrument has an inductive coupler positioned at its top end that is in communication with an inductive coupler positioned at a bottom end of the drill pipe carrier if the instrument is at the retracted position.

14. The method of claim 10 further comprising: transmitting power to the instrument from an adapter sub positioned between the drill pipe carrier and the drill string.

15. The method of claim 10 further comprising: deploying the drill pipe carrier and the instrument from the surface wherein the instrument is in the retracted position.

16. The method of claim 10 wherein the drill pipe carrier has an inductive coupler positioned at its top end for transmitting data to the drill string.

17. The method of claim 10 wherein the instrument is in communication with the drill pipe carrier via a wireline cable that has substantially a same length as the drill pipe carrier.

18. The method of claim 10 wherein the instrument is exposed to the formation surrounding the wellbore at the extended position.

19. The method of claim 10 wherein data is transmitted from the instrument to the drill pipe carrier via the cable.

* * * * *